US009157255B2

(12) United States Patent
Stendal

(10) Patent No.: US 9,157,255 B2
(45) Date of Patent: Oct. 13, 2015

(54) LOCKING DEVICE WITH BLOCKING MEMBER, CATCH AND CONTROL MEMBER

(75) Inventor: Jan Stendal, Vasteras (SE)

(73) Assignee: Stendals El AB, Vasteras (SE)

( * ) Notice: Subject to any disclaimer, the term of this patent is extended or adjusted under 35 U.S.C. 154(b) by 109 days.

(21) Appl. No.: 13/704,262

(22) PCT Filed: Jun. 16, 2011

(86) PCT No.: PCT/SE2011/050751

§ 371 (c)(1),
(2), (4) Date: Dec. 14, 2012

(87) PCT Pub. No.: WO2011/159243

PCT Pub. Date: Dec. 22, 2011

(65) Prior Publication Data

US 2013/0168981 A1 Jul. 4, 2013

(30) Foreign Application Priority Data

Jun. 17, 2010 (SE) ..... 1050625

(51) Int. Cl.
*E05B 15/02* (2006.01)
*E05B 17/20* (2006.01)
*E05B 47/00* (2006.01)

(52) U.S. Cl.
CPC ..... *E05B 15/022* (2013.01); *E05B 17/2011* (2013.01); *E05B 47/0047* (2013.01); *Y10T 292/696* (2015.04)

(58) Field of Classification Search
USPC ..... 292/341.15, 340, 341, 341.17
See application file for complete search history.

(56) References Cited

U.S. PATENT DOCUMENTS

| | | | | |
|---|---|---|---|---|
| 4,056,277 | A | 11/1977 | Gamus et al. | 292/341.16 |
| 5,484,180 | A | 1/1996 | Helmar | 292/341.16 |
| 5,605,066 | A | 2/1997 | Hurskainen | 70/278.3 |
| 7,111,877 | B2 * | 9/2006 | Larsen et al. | 292/216 |

FOREIGN PATENT DOCUMENTS

| | | |
|---|---|---|
| EP | 1 590 545 B1 | 11/2005 |
| ES | 2299303 | 5/2008 |
| WO | WO 97/05352 | 2/1997 |

OTHER PUBLICATIONS

International Search Report in PCT/SE2011/050751 mailed Sep. 29, 2011.

* cited by examiner

*Primary Examiner* — Mark Williams
(74) *Attorney, Agent, or Firm* — Norton Rose Fulbright US LLP

(57) ABSTRACT

The present invention relates to a locking device suitable for allowing or restricting access into an area or space. According to one aspect the locking device comprises locking device comprises at least one locking element, such as a bolt or cam, and a catch arranged to immobilize the locking element. According to another aspect the locking device comprises at least one locking element, such as a bolt or cam, and a blocking member arranged to block the locking element from moving, and a catch arranged to immobilize the blocking member. The locking device further comprises a control member arranged to both move the locking element or the blocking member and to control the state of the catch.

15 Claims, 3 Drawing Sheets

LOCKING DEVICE WITH BLOCKING MEMBER, CATCH AND CONTROL MEMBER

TECHNICAL FIELD

Figure 1A:
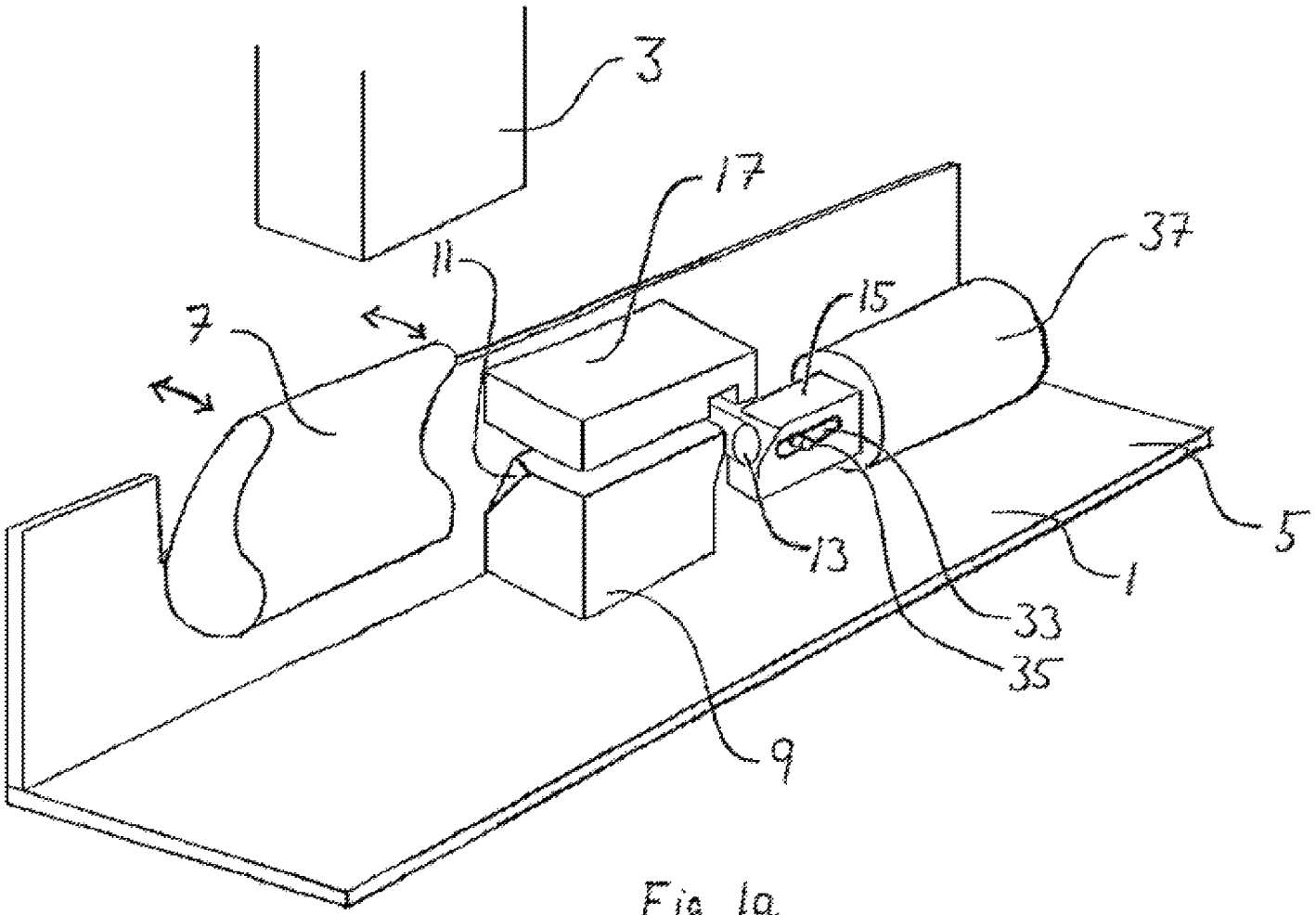

The present invention relates to a locking device suitable for allowing or restricting access into an area or space.

PRIOR ART

Locking devices for restricting access into an area or space are known in the art. Locking devices usually comprises one or more locking elements, such as a bolt, a bar or similar, for denying the opening of a closing element barring an opening into the area, such as a door, lid, window, hatch or similar. The positions of the bolts or bars are controlled by actuation of a lock requiring a key, key code, key signal or similar to be operated. In general, a locking device comprises a chain of mechanical links arranged between the lock and the locking element, which mechanical links are arranged to either allow or disallow movement of, and/or control the extension or retraction of, the locking element and thus the locking of the closing element, depending on the state of the lock.

One example of a lock and locking device is shown in patent document U.S. Pat. No. 5,605,066 in which the locking device comprises a dead bolt extendable into a hollow in a door jamb for holding a door closed. The locking device further comprises an electric motor arranged to control the position of two steel balls, which steel balls are arranged to move into and out of a position behind the dead bolt in order to prevent movement of the dead bolt in its protruding position. When retracting the dead bolt the electric motor first moves the steel balls into non-preventing positions, after which the dead bolt is retracted by the turning of a lock cylinder.

Another example of a locking device is shown in patent document U.S. Pat. No. 5,484,180, in which the locking device is intended to be arranged inside a door jamb. In this example the locking device is a strike plate comprising a hollow for receiving an extended locking bolt for locking the door. The locking device further comprises a cam arranged to, in a non-rotating state, hold the extended bolt in the hollow, and to, in a rotating state, allow the locking bolt to pass the rotating cam and out of the hollow. The cam is held in its non-rotating state by use of a hook. Patent document U.S. Pat. No. 4,056,277 shows a similar device in which the cam is held in its non-rotating state by use of a metal ball. When opening the locking device the hook or the metal ball is first retracted, after which the cam is rotated by the bolt pressing onto and rotating the cam.

SUMMARY OF THE INVENTION

One objective of the present invention is to indicate a locking mechanism providing high security and functionality with a compact and reliable design.

According to a first aspect of the invention this objective is achieved with the locking device according to the independent claim 1.

The indicated locking device comprises a blocking member for vlocking the movement of a locking element, and a catch arranged to, in a first state, engage the blocking member in its first, blocking position in order to hold the blocking member immobile, and, in a second state, to allow movement of the blocking member to its non-blocking state. The locking device is further provided with a control member arranged to control both the state of the catch used to immobilize the blocking member and to control the actual movement of the blocking member. Hence the locking device may be designed more compactly since both the blocking member and the catch for the blocking member may be moved and/or controlled with the same control member.

The catch is preferably arranged to immobilize the blocking member by engaging one or more portions or structural features of the blocking member. When the catch engages and immobilizes the blocking member, the blocking member is obstructed from being pushed back from a position in which the blocking member aids in restricting access. Hence a more secure locking device is achieved since the locking element is blocked by the blocking member, which in turn is immobilized by the catch, to restrict manipulation. Hence, the locking element cannot be tampered with by an intruder without first also tampering with both the blocking member and with the catch, which increases the security of the locking device. Preferably, the catch is itself arranged to avoid the transferring of any movement to the blocking member, wherein the function of the catch may more easily be guaranteed. In order to move the blocking member the catch hence needs to be in its second, non-immobilizing state. By controlling the state of the catch with the same member that moves the blocking member there is less difficulty with coordinating the mechanism of the locking device, leading to a more reliable locking device. The design according to the invention also requires a fewer number of movable members, wherein there may be less wear and a smaller chance of failure. Based on the reduced number of members the mechanism may also be designed even more compactly so as to reduce the need for space for the device.

Preferably the control member is arranged to control the state of the catch and of the blocking member based on its position. Preferably the control member is arranged to control the state of the catch and of the blocking member on a purely mechanical basis. Preferably the control member is movable, and arranged to control the changes in state for the catch and the position of the blocking member by its movement or position, so that the position of the catch and blocking member changes with the movement or position of the control member. Preferably the control member is also arranged to move and/or to transfer motion to the catch and the blocking member.

Preferably, the blocking member and/or the catch are shaped so that an external force acting on the blocking member for pressing the blocking member to its non-blocking state is transferred to and presses the catch in a direction further towards its first state. Hence the catch will be more difficult to move out of its immobilizing state by someone pressing on or tampering with the blocking member. This may be achieved by designing the catch and blocking member so that the catch is pressed against the blocking member to create frictional forces holding the catch even harder in its first state.

Preferably the control member in itself comprises one single member only, arranged to transfer movement to the blocking member and to change the state of the catch. However, the control member may in turn be connected with a lock through additional links, members or elements within the locking mechanism, for generating or transferring movement to the control member. In another embodiment the control member may instead comprise an electric drive for moving the catch and the blocking member. Preferably the control member is an integrated part of the locking device. Hence, a key or similar is not intended to be included in the definition of the control member. In one embodiment the locking element may also be moved by the same control member as moves the blocking member and the catch. However, the locking mechanism may also comprise other links or members, other than the control member, to achieve the movement of the locking element.

A locking device may comprise any number of movable and stationary links and members necessary for restricting or allowing the access into the area or space. The locking device may be arranged to cooperate with one or more additional locking devices of a similar, a mutually corresponding, or of a different type, and one or more closing elements arranged to close an opening, such as a door, hatch, gate etc. The closing element is normally locked by barring the closing element from moving in a position in which it covers the opening by use of the one or more locking devices.

A blocking member may be any member arranged to be at least partly immobilized in its blocking position, preferably by the catch, and possibly also in part by the control member. The blocking member is preferably arranged to block the movement of the locking element directly, but may also be arranged to block the locking element indirectly by being arranged to block a chain of members and/or elements for moving the locking element. Preferably the blocking member is arranged to indirectly or directly block the locking element by occupying a space into which the locking element needs to move in order to open or become unlocked. The blocking member is preferably also movable into a second position in which the blocking element is arranged to allow movement of the locking element and allowing said access into the area or space.

According to one embodiment the catch is arranged to immobilize the blocking member by forming a fixed mechanical connection between the blocking member and a fixed catch engagement member, in the first state of the catch. The fixed engagement member is preferably stationary relative to a housing of the locking device. In one embodiment the fixed engagement member is a wall portion of the locking device. In one embodiment the fixed engagement member is fixedly attached to the housing of the locking device.

The catch may comprise a hook-design arrangement, wherein a hook or other form of gripping element or structure grips or engages an engagement counterpart, such as a pin or notch, for immobilizing the blocking member. Preferably however, the catch comprises a solid body arranged to traverse a distance between the blocking member and a fixed engagement member, and being at least partly accommodated and held in both the fixed engagement member and in the blocking member. Hence the blocking member becomes anchored to the fixed engagement member. Preferably the fixed engagement member and the blocking element are adjacent, and more preferably abutting to each other, wherein the distance is small or close to zero. Preferably the catch comprises only one member or body. Preferably the body is movable between a first state, in which the body is simultaneously accommodated inside the first catch cavity in the blocking member and inside a second catch cavity in the fixed engagement member for immobilizing the blocking member, and a second state, in which the catch has moved out of at least one of the cavities to disconnect the blocking member and the fixed engagement member from each other. Preferably at least a majority of the catch is then accommodated only one of the catch cavities.

According to one embodiment the control member is arranged to move along a movement path, wherein the control member is adapted to mainly move the blocking member while moving along a first part of the path and to mainly control the state of the catch while moving along a second part of the movement path. The locking mechanism, and in particular the control member, are preferably designed so that at least a major part of the first and second parts, respectively, are separated. Preferably, the first and second parts of the movement path are completely separated. However, the locking mechanism, and in particular the control member, may be designed so that the first and second parts of the movement paths partly coincide. Since the catch needs to be moved to the second state before movement of the blocking member is allowed, it is advantageous that the control member at least to some extent controls the catch and the blocking member along separate parts of its movement path. In another embodiment the movement rate of the catch and blocking member respectively, may differ in magnitude between a first and a second part of the movement path of the control member. Alternatively the catch may be designed with a play between the catch and the blocking member, so that movement of the blocking member may begin before the catch has reached its second state.

Preferably, the control member is arranged to control the state of the catch towards one end of the movement path. Preferably, the control member is arranged to control the state of the catch towards the end of the movement path towards which it moves when moving the blocking member towards its blocking position. Hence, the catch will be slid in place after the blocking member reaches its blocking position and will also be removed before the blocking member is to be moved. Preferably the control member is also arranged to move the blocking member towards the opposite end of the movement path.

According to one embodiment the control member comprises a bevelled surface adapted to exert a force acting on the catch in a direction towards its first state and to move the catch in a direction different from the movement direction of the control member and/or from the movement direction of the blocking member. Preferably the bevelled surface of the control member exerts a force acting to move the catch in a direction at an angle of between 30-150° from the movement direction of the control member and/or the movement direction of the blocking member, more preferably at an angle of between 45-135°, a most preferably in between 60-120°. Preferably the surface is adapted to exert a force acting to move the catch in a direction perpendicular to the movement direction of the control member. Thus the control member will move the catch in a direction away from the movement path of the control member, so that the catch will not obstruct the movement of the control member. Preferably the catch is arranged to rest onto and to be held in position by the bevelled surface in its first state. Preferably the catch is furthermore biased to move back towards its second state when the control member is withdrawn. Hence it is not necessary for the control member to operate on the catch with a force when releasing the catch. Preferably, the catch is then adapted to slide along and on the bevelled surface when returning to its second state. Due to that the surface is bevelled the frictional force acting on the catch will be small, so as to allow movement without the catch becoming stuck.

According to one embodiment the catch comprises a body having a surface bevelled relative to the movement direction of the catch and which bevelled surface of the body is arranged to rest onto the bevelled surface of the control member. By arranging a bevelled surface on the body of the catch the movement of the catch is facilitated. Preferably the catch also comprises a bevelled surface arranged to make contact with a surface in a catch cavity. Hence, the catch may more easily be inserted and withdrawn into and out of the catch cavity. Preferably the body is shaped as a ball, wherein the movement of the body is simplified even further.

According to one embodiment the blocking member comprises a blocking surface arranged to block the locking element from moving in order to restrict access into the area or space. Preferably neither the blocking member nor the catch, are in themselves arranged to transfer any movement to or towards the locking element, whether directly or indirectly. The blocking surface is preferably bevelled in relation to the movement direction of the blocking member. Hence the frictional force when moving the blocking member into or out of its blocking position is decreased. Preferably the blocking surface is bevelled also in relation to the movement direction of the locking element. Preferably the bevelled surface is angled so as to face in a direction away from the movement direction of the blocking member when retracting the blocking member. Hence, when the locking element is pressed against the blocking member by external forces, it is easier to retract the blocking member due to the bevelled surfaces and the correspondingly reduced frictional forces.

According to one embodiment the locking device comprises a combination of a bevelled surface arranged on the blocking member for blocking a locking element, a bevelled surface arranged on the catch to bear against the control member, and a bevelled surface arranged on the control member to bear against the catch. Thus, a total of at least three bevelled surfaces are provided in the mechanism controlling the locking element. This gives much lessened friction when releasing or unlocking a locking element which is currently under strain.

According to one embodiment the blocking member comprises a control member channel arranged to at least partly accommodate the control member inside the blocking member. Thus the control member may control the movement, and thus the state, of the blocking member from within the blocking member, leading to a more compact locking device.

According to one embodiment the blocking member and/or the control member comprises a slot of a limited length, and the other of the blocking member and/or the control member comprises a sliding element arranged to slide in and along said slot. In a preferred embodiment the blocking member comprises the slot, and the control member comprises the sliding element. The slot and the sliding element are further arranged to allow a transfer of movement between the control member and the blocking member, and also to guide the movement of the control member and the blocking member relative to each other. When the sliding element reaches an end section of the slot movement may be transferred between the control member and the blocking member by the sliding element acting on the terminal wall section of the slot. When the sliding element slides along the slot however, no movement is transferred, hence allowing movement of the control member without any transfer of movement to the blocking member. In case the control member is arranged inside a control member channel within the blocking member, the control member channel and the slot are preferably arranged in connection with each other.

According to one embodiment the locking element may be a bolt arranged to extend into a hollow in a door jamb or strike plate, wherein the blocking element is arranged to block movement of the bolt. The locking device is then preferably a mortise lock arranged inside the leaflet of a door.

According to another embodiment the locking element comprises a movable cam arranged in a jamb lining an opening into the area or space, which cam is arranged to hold or release a bolt adapted to, in a first locking position, lock a closing element in a position in which it covers the opening, and, in a second, non-locking position, allow opening of the closing element. The cam is furthermore arranged to be movable in an unlocked state to allow passage of the locking element out of (and into) engagement with the cam. The blocking member is then arranged to block movement of the cam in the first state of the blocking member, in order to force the cam into engaging with the locking element. Preferably the locking device comprises a strike plate comprising a rotatable cam arranged in connection with a hollow for receiving the locking element, which strike plate further comprises the blocking member, the catch and the control member. Preferably, the locking device is furthermore an electrical strike plate, wherein the state of the cam and the movement of the blocking element by the control member is electrically controlled and driven.

According to a second aspect of the invention the objective given above is also achieved with the locking device according to the independent claim 13.

The locking device comprises at least one locking element, such as a bolt or cam, movable between a first, locking position, in which the locking element is arranged to be held immobile in order to restrict said access, and a second position, in which the locking element is unlocked, and a catch arranged to, in a first state, immobilize the locking element in its first, locking position, and to, in a second state, allow movement of the locking element out of its first state. The locking device further comprises a movable control member arranged to control both the state of the catch and the movement of the locking element. Thus the locking element will be more securely immobilized by the catch in its locking position, while the locking device may be compactly designed and easily controlled by the control member.

This locking device shares many of the advantages with the locking device as described previously according to the first aspect of the invention, and indeed the present locking element may be designed to include similar features as the features of the blocking member described above. Preferably the locking element is then shaped as a straight locking bolt moving with a linear motion. The control member is arranged to move both the bolt and to change the present state of the catch.

In another embodiment however the control member is rotatable, and that the locking element is pivotably attached to the control member for movement between its first and second positions. Preferably both the locking element and the control member are pivotable and arranged to co-move. Preferably the catch comprises a solid body arranged to lock the control member and the locking element from rotating relative to each other. Since the movement of both the locking element and the control member are restricted at other points, the locking of the relative rotation effectively immobilizes both the locking element and the control member from tampering.

BRIEF DESCRIPTION OF THE ATTACHED DRAWINGS

The invention is now to be described as a number of non-limiting examples of the invention with reference to the attached drawings.

FIGS. 1*a-d* shows a locking device in the form of a strike plate comprising a locking element in the form of a cam, and which comprises a blocking member and a catch according to one example of the invention.

FIG. 2 shows a second example of a locking device comprising a locking element, a catch, and a control member for controlling the state of the catch and the movement of the locking element.

DETAILED DESCRIPTION

In FIG. 1*a* a locking device 1 in the form of a strike plate according to one example of the invention is shown. In the figures only the parts having bearing to the invention are shown in order to increase readability and visibility. The omitted parts however are well known in the art and can be found in literature on electric strike plates.

In this example the locking device is a strike plate adapted to be fixedly arranged inside a door jamb or similar. The locking device is arranged to lock a closing element from opening, which closing element is adapted to cover an opening into an area or space, and may be a door, hatch, lid or similar. The closing element is provided with a corresponding locking device of its own, which in this example comprises a locking bolt 3 arranged to be extended in a first, locked state, as shown in FIG. 1*a*, and to be retracted in a second unlocked state.

The locking device comprises a housing 5 enclosing the locking mechanism and forming a hollow adapted to receive the locking bolt in the extended state of the bolt. The locking device also comprises a cam 7 arranged in connection with the hollow and adapted to hold the locking bolt 3 inside the hollow. The cam 7 is then arranged to, in a first, locked state, obstruct the extended locking bolt from moving out of the hollow in the direction of opening the closing element, and, in a second unlocked state, to be rotatable in order to allow the locking bolt to pass out of the hollow for allowing opening of the closing element. Hence the closing element may be unlocked either by retracting the locking bolt and/or by letting the cam rotate, and correspondingly the closing element is locked by the combination of blocking the cam from rotating and extending the locking bolt into the hollow.

The locking device 1 further comprises a blocking member 9 arranged to, in a first blocking state, block the cam 7 from rotation. The blocking member 9 is then arranged to be positioned in the movement path of the cam in order to block the cam from rotating, wherein the blocking member is arranged to occupy a space into which the cam needs to move in order to be able to rotate. The blocking member comprises a blocking surface 11, which is adapted to make contact with a mutually corresponding surface 41 provided on the cam in order to block the cam from rotating. The blocking member is further movable into a second, unblocking position, wherein the movement path of the cam is left unobstructed so that the cam may rotate.

An unauthorized individual may try to open the lock by applying a strong force onto the cam 7, in order to force the cam to rotate and let the locking bolt out of the strike plate for opening the closing element. In order to enhance the security of the locking device, the locking device hence comprises a catch 13 arranged to immobilize the blocking member 9 from movement when the blocking member is in its blocking position and when the catch is in a first state. The catch 13 is further arranged to allow movement of the blocking member in a second state of the catch. In case a force is applied onto the cam, either by pressing onto the cam or by knocking, the catch thus prevents the blocking member from moving.

The locking device further comprises a control member 15 adapted for both moving the blocking member between its blocking and non-blocking positions, and to control the state of the catch 13. In this example the control member 15 is movable and is arranged to move the catch between its states by changing the position of the catch. By arranging a common control member 15 for controlling both the position of the blocking member 9 and the state of the catch 13 a more compactly designed locking device may be achieved. Furthermore, the reliability increases since there is less risk that only one of the blocking member or catch is moved, as would be the case if they had been operated separately, or that the blocking member 9 is actuated to move in advance of removing the catch.

The locking device comprises a catch engagement member 17, which is fixed relative to the housing of the locking device, and arranged to provide at least one surface or other feature providing a bracing for and engaging with the catch. In this example the engagement member 17 is fixedly attached to a wall portion of the housing 5 of the locking device. The catch is in turn arranged to engage with both the catch engagement member 17 and with the blocking member 9 in the first state of the catch, in order to immobilize the blocking member. In this example the catch 13 comprises a solid body arranged to traverse the distance, and to form a mechanical connection, between the blocking member and the engagement member for fixedly securing the blocking member. To this end the catch is adapted to bear against one or more surfaces on both the blocking member and the engagement member, and to transfer forces from the blocking member to the engagement member so as to hold the blocking member in place. In the second state of the catch, the catch is arranged to free the blocking member for movement by avoiding to form any mechanical connection between the blocking member and the engagement member.

In this example the engagement member 17 comprises a catch cavity 19 arranged to at least partly accommodate the catch inside the cavity in the first state of the catch. The catch cavity 19 is also arranged to hold the catch 13 firmly inside the cavity in the first state by the surfaces of the cavity tightly bearing against the catch. Hence the catch may transfer forces in a large number of directions and/or angles to the engagement member in its first state. The blocking member 9 similarly comprises a catch cavity 21 for at least partly accommodating and firmly holding the catch 13 inside the cavity in the first state of the catch, similar to the engagement member. The catch is furthermore solid and stiff and thus transfers any forces originating from movement of the blocking member 9 from the blocking member to the engagement member 17. In the second state the catch is adapted to be positioned outside at least one of the catch cavities 19, 21 of the engagement member or the blocking member, wherein the catch cannot transfer any forces to the engagement member from the blocking member, and hence also allows movement of the blocking member.

The locking device further comprises a spring 23 arranged inside one of the catch cavities, in this example in the catch cavity 19 of the engagement member, which spring is arranged to push the catch out of the cavity. The control member 15 in turn comprises a bevelled surface 15 arranged for pushing the catch into the catch cavity against the force of the spring and towards the first state of the catch. Hence, by moving the control member the state of the catch may be controlled by pushing or letting the catch into or out of the catch cavity. Hence the control member controls the state of the catch in cooperation with the spring.

In this example the blocking member 9 comprises a channel 27 adapted to at least partly accommodate the control member 15 inside the channel. The channel is further provided with a surface 29 at the end of the channel, and the control member is adapted to move the blocking member by pressing onto the surface. The channel is further provided with side surfaces guiding the movement direction of the control member inside the channel. In this example the channel is surrounded by, and almost completely contained inside, the blocking member, but in another example the channel could also be provided on the surface of the blocking member. The channel 27 is further provided with a channel opening 31 for letting the control member pass in and out of the channel. Furthermore, the space of the channel is connected with the hollow of the catch cavity 21, so that the control member 15 may control the state of the catch from within the channel. In this example the control member 15 comprises a piston slidably arranged inside the channel. The end of the piston arranged furthest into the channel is provided with the bevelled surface 25 arranged to bear against and control the state of the catch.

The blocking member 9 is further provided with a slot 33, which is arranged to run along a limited length of the channel. The control member is provided with a sliding element 35, in this example in the form of a pin, which is arranged to run in and slide along the slot. In this example the sliding element is attached onto the body of the piston. The combination of the sliding element 35 and the slot 33 thus exert a control of the relative motion between the blocking member and the control member, and also aids in transferring motion and forces between the members. In particular, the sliding element 35 may transfer motion from the control member 15 to the blocking member 9 for moving and changing the position of the blocking member when reaching and pressing onto a terminal end surface of the slot 33, while refraining from moving the blocking member while the sliding element slides along the slot. Naturally, the slot could instead be provided on the control member, and the sliding element on the blocking member.

The locking device further comprises a solenoid 37 arranged to provide motion to the control member and hence to move the blocking member and the catch. In this example the solenoid 37 is arranged to move the piston of the control member through the action of a magnetic or electric field generated in the solenoid. The operation of the solenoid is in turn controlled by a logical or electrical circuit (not shown), which is arranged to receive input signals from a user when the user turns a key, operates a remote control, or any other form of lock actuator. Hence the movement of both the blocking member and the catch originates from the same source and is transferred via the same control member.

Figure 1B:
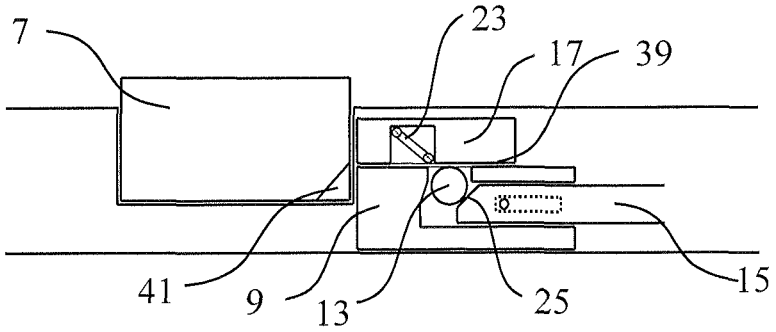

In the following the operation of the locking device is shown with reference to FIGS. 1*b-d*. In FIG. 1*b* the locking device 1 is shown in an unlocked state. The blocking member 9 is positioned in a non-blocking position, in which the blocking member is thus located beside the cam, so that the cam may rotate without hindrance. The catch 13 is accommodated inside the catch cavity 21 of the blocking member, and also projects down into the channel 27 so as to rest on the beveled surface 25 of the control member 15. The engagement member 17 comprises a catch depressing surface 39 arranged above and in level with the opening into the catch cavity 21 of the blocking member, so as to ensure that the catch remains inside the cavity.

Figure 1C:
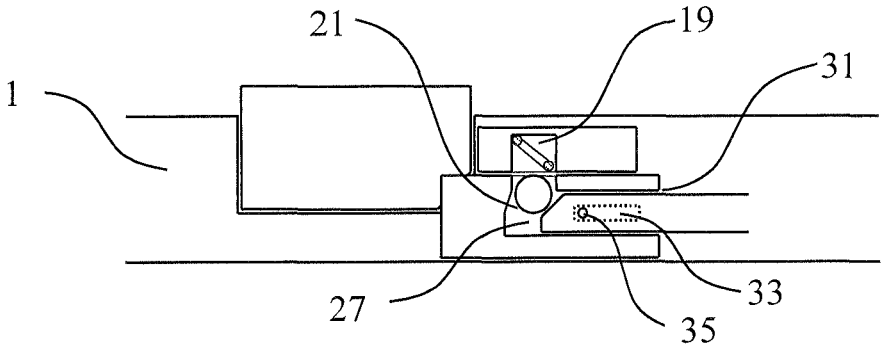
Figure 1D:
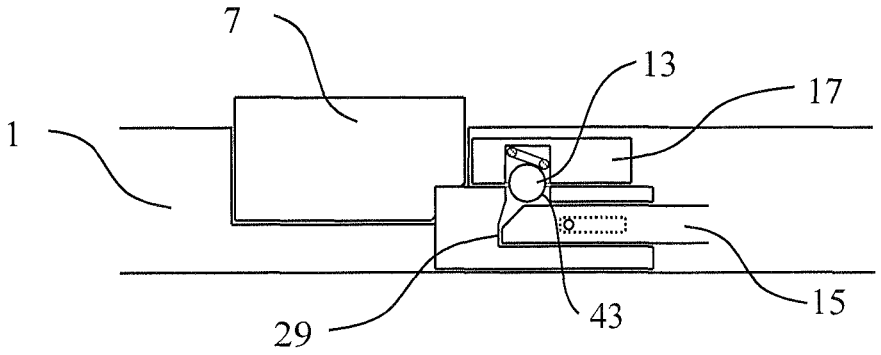

Moving from FIG. 1*b* towards FIG. 1*c* the control member 15 is pushed to the left in the figure, so as to move the blocking member 9 towards its first, blocking state. The catch depressing surface 39 continues to hold down the catch inside the catch cavity of the blocking member 9, and thus, along a first part of the movement path of the control member, the control member 15 moves the blocking member without affecting the state of the catch 13. The force from the control member to the blocking member may be transferred via either or both of the catch pressing against a wall surface of the catch cavity and/or the sliding element pressing against an end surface of the slot.

In FIG. 1*c* the catch 13 has reached the opening to the catch cavity 19 in the engagement member 17, wherein the catch is pushed into the catch cavity of the engagement member by the beveled surface 25 of the control member. Hence the state of the catch is controlled along a second, and later, part of the movement path of the control member 15. The catch is pressed into the catch cavity of the engagement member, as shown in FIG. 1*d*, so as to traverse the distance, and to form a mechanical connection, between the blocking member and the engagement member for immobilizing the blocking member 9. Simultaneously the blocking member is slid in place beneath the cam 7, so as to occupy a space in the movement path of the cam, wherein the cam is locked from rotating. The cam thus prevents the locking bolt 3 from exiting the hollow behind the cam, so that the closing element is locked.

Upon unlocking the cam 7, the control member 15 is retracted along a first part of its movement path, so that the catch 13 is pressed back into the cavity of the blocking member (going backwards from FIG. 1*d* to FIG. 1*c*) by the spring 23. The blocking member is then no longer immobilized by the catch. The control member avoids transferring any motion to the blocking member during this 'second' part of the movement path. Simultaneously with the catch being released, the sliding element 35 reaches the back end of the slot, and hence begins to transfer motion from the control member to the blocking member 9 for removing the blocking member from blocking the cam.

One possible drawback with blocking the cam 7 with a blocking member 9 is that if the cam is loaded with a force, for example from the bolt, the cam will be pressed towards the blocking member leading to an increased friction, which may prevent the blocking member from being retracted and preventing the closing element from becoming unlocked. To alleviate this problem the blocking member 9 is thus provided with a bevelled blocking surface 11 arranged to make contact with the cam 7, which dramatically decreases the frictional forces experienced by the blocking member when the cam is loaded. However, the angling of the blocking surface 11 may lead to that the force loading the cam will simultaneously apply a force pressing the blocking member towards its non-blocking state. This detrimental effect is to a large part negated by the inclusion of said catch 13.

The catch 13 is in this example shaped as a ball, and is hence similarly provided with a bevelled surface 43 bearing against the blocking member, and the surface of the control member being in contact with the catch is also bevelled, bringing the number of bevelled surfaces up to three. Hence the frictional forces which could contribute in making a part or parts of the locking mechanism getting stuck are reduced. In this example all three bevelled surfaces 11, 25, 43 are angled so as to face in directions being at an angle to the movement directions of all three of the blocking member, the control member and the catch, so as to reduce the frictional forces in all these instances.

Even though this invention has been described as a preferred embodiment in the form of a strike plate, the mechanism of a joint control member for both a blocking member and a catch may be equally applicable to other cases as well, such as a blocking member provided to block a locking element in the form of a locking bolt from moving.

Figure 2A:
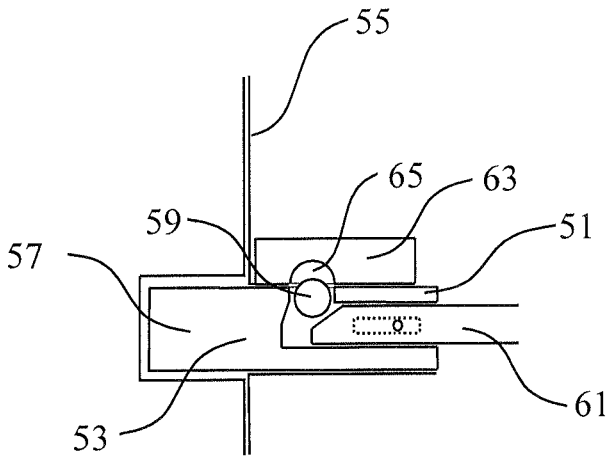
Figure 2B:
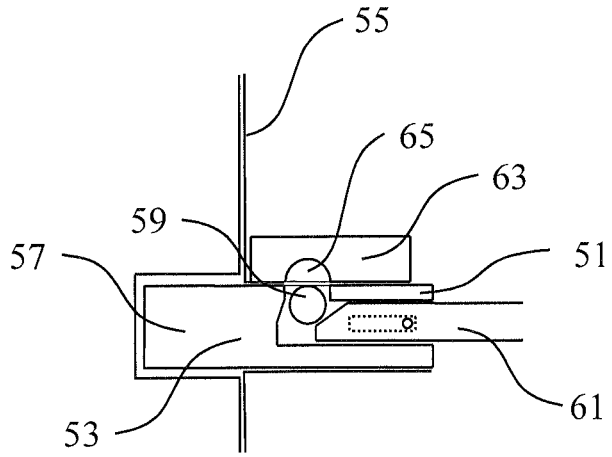

In FIG. 2*a-b* another example of a locking device 51 according to a second aspect of the invention is shown. In this example the locking device is a lock comprising a locking element 53 in the form of a locking bolt, and which is adapted to be attached with a closing element 55 arranged to cover an opening into an area or space for restricting access into the area or space. The locking bolt 53 comprises a blocking part 57 arranged to be extended into a hollow or similar engagement part located in a jamb or in another closing element, for holding the closing element locked.

According to the invention the locking device 51 comprises a catch 59 arranged to immobilize the locking element 53 in much the same way as the catch 13 in the previous example immobilized the blocking member 9. The locking device 51 further comprises a control member 61 arranged to control both the movement and position of the locking element 53 and the state of the catch 59 in response to actuation of a lock cylinder with a key, signals from a remote control, or other forms of user input.

The locking device further comprises a catch engagement member 63 provided with a catch cavity 65. In this example the catch 59 is spherical, and the catch cavity is dome-shaped. The inner surface of the catch cavity 65 is slightly angled, so that when the catch is pushed towards the surface, for example when retracting the locking element, a force is applied onto the catch 59 which pushes the catch out of the catch cavity 65. Hence there is no need for a spring. Since the angle of the dome-shaped surface is very shallow at the opening into the cavity 65 the pushing force is small and not sufficient for pushing the catch to displace the control member in case someone applies a strong depressing force onto the locking element.

In FIG. 2*b* the locking device is shown in a state in which the locking element is being retracted. The control member has been moved to the left in the figure, and the pin makes contact with the leftmost end of the slot, so as to transfer motion from the control member to the locking element. The catch has also fallen down into the channel formed inside the locking element, either due to gravity, or, as here, due to the bevelled surface of the catch cavity.

In most other respects the locking device 51 in FIG. 2 is designed in a corresponding manner, and includes the features of, the locking device as shown in relation to FIGS. 1*a-d*, however excluding the cam and substituting the blocking member with the locking element.

The invention is not limited to the embodiments shown but may be varied freely within the framework of the following claims.

In particular, the shapes of the locking element, the blocking member, the catch, and the control member may be arbitrarily selected as long as they are able to perform their intended function. Also the sizes, positions and orientations of the different elements and members may be arbitrarily changed to fit the geometry of a specific locking device. Even though the movement paths of the members and elements are depicted as mostly linear, any, or all of them may be designed to move along a rotating path or a curvilinear path. One or both of the blocking member and the catch could also be designed in the form of hooks instead of solid bodies, and the control member may be operated through mechanics rather than through an electrical device. Finally, the features shown for the device in FIGS. 1*a-d* could also be implemented with the device in FIG. 2, and vice versa.

The invention claimed is:

1. A locking device suitable for allowing or restricting access into an area or space, the locking device comprising at least one locking element, movable between a first, locking position, in which the locking element is arranged to be held immobile in order to restrict said access, and a second position, in which the locking element is unlocked, and a blocking member movable between a first, blocking position, in which the blocking member is arranged to block the locking element from moving, and a second, non-blocking position, characterized in that the locking device further comprises a catch arranged to, in a first state, immobilize the blocking member in its first, blocking position, and, in a second state, to allow movement of the blocking member out of its first state, and a movable control member arranged to control both the state of the catch and the movement of the blocking member;

characterized in that the control member comprises a bevelled surface adapted to exert a force acting on the catch in a direction different from the movement direction of the control member and/or the blocking member; and the blocking member comprises a catch cavity arranged to at least partly accommodate the catch inside the blocking member.

2. A locking device according to claim 1, characterized in that the control member is arranged to move along a movement path, wherein the control member is adapted to move the blocking member while moving along a first part of the path and to control the state of the catch while moving along a second part of the path.

3. A locking device according to claim 2, characterized in that the control member is arranged to control the state of the catch towards one end of the movement path.

4. A locking device according to claim 1, characterized in that the locking device comprises a catch engagement member fixed relative to the locking device, and the catch comprises a solid body arranged to engage with both the blocking member and the catch engagement member in the first state of the catch.

5. A locking device according to claim 4, characterized in that that the solid body of the catch is arranged to be at least partly accommodated and held inside a cavity in both the blocking member and the fixed engagement member in the first state of the catch.

6. A locking device according to claim 1, characterized in that the blocking member comprises a control member channel arranged to at least partly accommodate the control member inside the blocking member.

7. A locking device according to claim 1, characterized in that the blocking member comprises a slot of a limited length arranged in connection with the channel, and that the control member comprises a sliding element arranged to slide in and along said slot.

8. A locking device according to claim 7, characterized in that the sliding element is arranged to transfer motion from the control member to the blocking member.

9. A locking device according to claim 1, characterized in that the locking element comprises a cam arranged in a jamb lining an opening into the area or space, which cam is arranged to hold or release a locking bolt adapted to, in a first locking position, lock a closing element in a position in which it covers the opening, and, in a second, non-locking position, allow opening of the closing element.

10. A locking device according to any of the claim 1, characterized in that the blocking member comprises a bevelled surface arranged to block movement of the locking element.

11. A locking device suitable for allowing or restricting access into an area or space, the locking device comprising at least one locking element, movable between a first, locking position, in which the locking element is arranged to be held immobile in order to restrict said access, and a second position, in which the locking element is unlocked, and a catch arranged to, in a first state, immobilize the locking element in its first, locking position, and to, in a second state, allow movement of the locking element out of its first state, characterized in that the locking device further comprises a movable control member arranged to control both the state of the catch and the movement of the locking element.

12. A locking device according to claim 11, characterized in that the control member is rotatable, and that the locking element is pivotably attached to the control member for movement between its first and second positions.

13. A locking device according to claim 12, characterized in that the catch comprises a solid body arranged to lock the control member and the locking element from rotating relative to each other.

14. The device of claim 1, wherein the at least one locking element is a bolt or cam.

15. The device of claim 11, wherein the at least one locking element is a bolt or cam.

* * * * *